United States Patent [19]

Sherrod et al.

[11] Patent Number: 5,042,088

[45] Date of Patent: Aug. 27, 1991

[54] DISPOSABLE CLOTHING SHIELD AND METHOD OF MANUFACTURE

[75] Inventors: Earle H. Sherrod, Appleton; Brigitte K. Weigert, Oshkosh; Lea A. Van Groll, Little Chute; Theresa R. Kuepper, Neenah, all of Wis.

[73] Assignee: Kimberly-Clark Corporation, Neenah, Wis.

[21] Appl. No.: 443,051

[22] Filed: Nov. 27, 1989

Related U.S. Application Data

[63] Continuation of Ser. No. 137,845, Dec. 23, 1987, abandoned.

[51] Int. Cl.[5] ..... A41D 27/13; B32B 33/00

[52] U.S. Cl. ..... 2/53; 2/56; 2/58; 428/41; 428/74; 428/80; 428/136; 428/137; 428/286; 428/287; 428/339; 428/340

[58] Field of Search ..... 2/53, 56, 58; 428/74, 428/80, 136, 137, 286, 287, 339, 340, 354, 41

[56] References Cited

U.S. PATENT DOCUMENTS

| | | | |
|---|---|---|---|
| 1,108,427 | 8/1914 | Brenan | 2/53 |
| 1,416,044 | 5/1922 | Martin | 2/53 |
| 1,912,178 | 5/1933 | Conoyer | 2/53 |
| 2,344,781 | 3/1944 | Mullen | 2/53 |
| 2,390,565 | 12/1945 | Topjian | 2/53 |
| 2,434,830 | 1/1948 | Billins | 2/56 |
| 2,438,771 | 3/1948 | Topjian | 2/53 |
| 2,654,888 | 10/1953 | Brightman | 2/53 |
| 2,669,720 | 2/1954 | Vandekerck | 2/55 |
| 2,685,086 | 5/1954 | Henry | 2/55 |
| 2,688,751 | 9/1954 | Kermode | 2/53 |
| 2,747,193 | 5/1956 | Pulsifer | 2/56 |
| 2,818,572 | 1/1958 | Oliver | 2/55 |
| 3,001,201 | 9/1961 | Hauser | 2/56 |
| 3,019,443 | 2/1962 | Rose | 2/55 |
| 3,077,603 | 2/1962 | Weaver | 2/55 |
| 3,141,174 | 7/1964 | Meier-Nieper | 2/53 |
| 3,145,391 | 8/1964 | Tyrrell | 2/56 |
| 3,156,924 | 11/1964 | Wonacott | 2/53 |
| 3,259,911 | 7/1966 | Tyrrell | 2/56 |
| 3,345,643 | 10/1967 | Bradley | 2/53 |
| 3,346,878 | 10/1967 | Morris | 2/54 |
| 3,423,760 | 1/1969 | Tyrrell | 2/58 |
| 3,588,916 | 6/1971 | Glatt | 2/53 |
| 3,727,237 | 4/1973 | Glatt | 2/56 |
| 3,885,247 | 5/1975 | Kost | 2/55 |
| 3,997,920 | 12/1976 | De Woskin | 2/53 |
| 4,409,052 | 10/1983 | Von Agris | 156/227 |
| 4,545,080 | 10/1985 | Gorham | 2/54 |
| 4,631,752 | 12/1986 | Heyman | 2/56 |
| 4,663,780 | 5/1987 | Rawlings | 2/53 |
| 4,797,171 | 1/1989 | Van Gompel | 156/322 |

FOREIGN PATENT DOCUMENTS

| | | | |
|---|---|---|---|
| 950722 | 10/1956 | Fed. Rep. of Germany | 2/53 |
| 2714301 | 10/1978 | Fed. Rep. of Germany | 2/55 |
| 3339474 | 5/1985 | Fed. Rep. of Germany | 2/53 |
| 467014 | 6/1914 | France | 2/53 |
| 2282822 | 3/1976 | France | 2/55 |
| 2496420 | 8/1982 | France . | |
| 2499832 | 8/1982 | France . | |
| 7605983 | 12/1977 | Netherlands | 2/53 |
| 4164 | 12/1983 | PCT Int'l Appl. | 2/53 |
| 622165 | 3/1981 | Switzerland | 2/54 |
| 83-04164 | 12/1983 | World Int. Prop. O. | 2/53 |

*Primary Examiner*—James C. Cannon

[57] ABSTRACT

The clothing shield is intended to protect clothing against body stains, such as underarm stains, and generally comprises a liquid-pervious bodyside liner, a liquid-impervious outer cover, and an absorbent medium between the liner and outer cover. The exposed side of the outer cover has a masking surface thereon that visually masks the clothing shield through the article of clothing. A method is also provided for making the shield.

28 Claims, 4 Drawing Sheets

DISPOSABLE CLOTHING SHIELD AND METHOD OF MANUFACTURE

"This is a continuation of co-pending application Ser. No. 07/137,845 filed on Dec. 23, 1987, and now abandoned

BACKGROUND OF THE INVENTION

The present invention relates to a clothing shield, and more particularly to a disposable clothing shield that protects clothing from stains and is visibly masked through the clothing.

There are various types of clothing shields, and they include both disposable and reusable types. Generally, they comprise a liquid-impervious outer cover and an absorbent medium attached thereto. In the past, these shields have generally been made of a cloth-like material and/or a cellulosic material. More recently, some shields have included thermoplastic materials in their structure.

Although current clothing shields have improved performances over earlier shields, they still possess several inherent disadvantages. For example, those that have increased absorbency due to added absorbent material are generally bulky and uncomfortable when worn in the underarm area.

Closely related to the problem of bulkiness and uncomfortable fit or feeling to the wearer is the fact that the bulkiness can provide a bulge at the underarm area that is visually discernible by others. This is another disadvantage to the wearer of this type shield. Discreetness of the shield is a paramount concern.

Another problem with current clothing shields is that the external surface, generally one side of the liquid-impervious outer cover, is visually discernible through the clothing of the wearer. Either the geometric shape is outlined through the clothing, or a particular design pattern on the outer cover is reflected through the clothing.

As with any type of underclothing, it is highly desirable that the article be comfortable to the wearer and not visible to others.

SUMMARY OF THE INVENTION

The present invention provides a clothing shield that is relatively lightweight and relatively thin so as to be comfortably worn by the wearer. Because the clothing shield is also relatively thin, it does not project or outline a pattern on the clothing that is easily seen by others.

The present invention also provides a clothing shield that has one surface that visually masks the shield through the clothing. The surface randomly scatters light reflected therefrom so as not to reflect or radiate a geometrically visible pattern or shape of the shield through the clothing.

In one form of the invention, there is provided an article for protecting clothing against stains and the like, and comprising an absorbent medium and a liquid-impervious outer cover adjacent to the absorbent medium. On the exposed side of the cover, there is a unique surface that randomly scatters light reflected therefrom, thereby visually masking the article through the clothing.

In another form of the invention, there is provided a method for making an article for protecting clothing against stains and the like, and comprises the steps of providing a liquid-impervious outer cover, and providing an absorbent adjacent the outer cover. There is created on an exposed side a masking surface that randomly scatters light reflected therefrom, thereby to visually mask the article from being seen through the clothing.

BRIEF DESCRIPTION OF THE DRAWINGS

The above-mentioned and other features and objects of this invention, and the manner of attaining them, will become more apparent and the invention itself will be better understood by reference to the following description of an embodiment of the invention taken in conjunction with the accompanying drawings, wherein.

DESCRIPTION OF A PREFERRED EMBODIMENT

Figure 1:
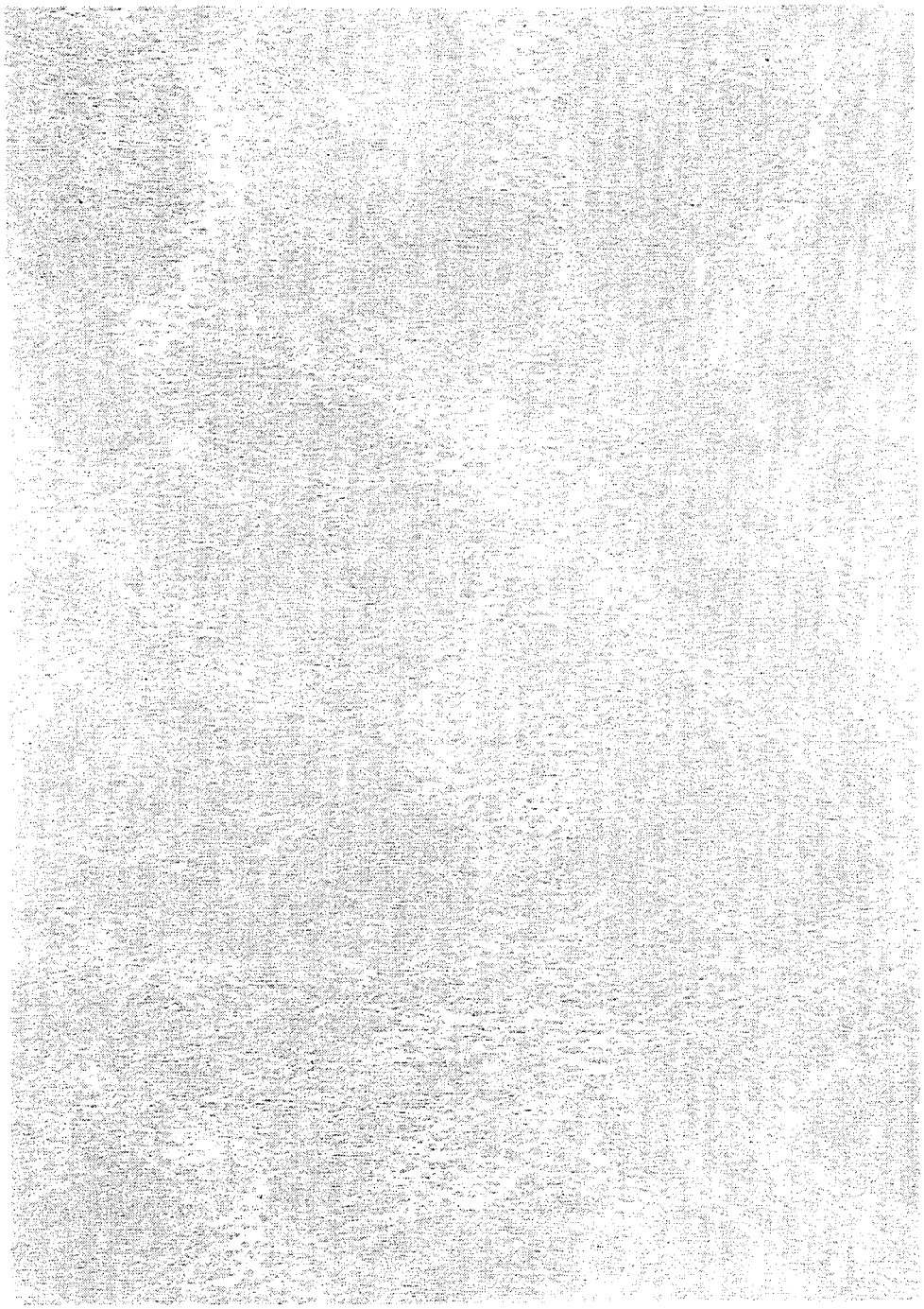
FIG. 1 is a photographic plan view of the masking surface side of a preferred embodiment of the present invention.

Referring to FIGS. 1-4, clothing shield 2 of the present invention is illustrated and generally comprises liquid-pervious bodyside liner 4, liquid-impervious outer cover 6, and absorbent medium 8 disposed between liner 4 and cover 6.

Bodyside liner 4 is made of a liquid-pervious thermoplastic material having a basis weight from about 0.3 to about 1.5 ounces per square yard, and a thickness generally from about 10 to about 20 mils. Preferably, bodyside liner 4 is a hydrojet-entangled layer of thermoplastic material. The thermoplastic material can be polyethylene or polypropylene, and more preferably is polyester. The hydrojet-entangled process results in a tangled-like web of thermoplastic microfibers that have increased softness over other processes. These particular types of microfibers refer to small diameter fibers having a diameter not greater than about 100 microns, preferably a diameter from about 0.5 to about 50 microns, and more preferably a diameter from about 4 to about 40 microns. The hydrojet-entangling process involves the use of an air forming process, wherein the bonding is due to fiber entanglement caused by water jets.

The hydrojet-entangled process provides a thermoplastic fibrous layer that is very soft and comfortable against the skin. One type of hydrojet-entangled web is Sontara manufactured by E. I. Du Pont Textiles Fibers Department of Wilmington, Del.

Alternative materials of which bodyside liner 4 can be made include spunbonded thermoplastic materials, such as spunbonded polyethylene and spunbonded polypropylene.

Bodyside liner 4 can further be a nonwoven web or sheet of polyolefin fibers, such as polypropylene, polyester, polyethylene, Rayon, and the like. It may also be a nonwoven web of synthetic or natural fibers or a blend thereof, a plastic film with perforations or an expanded plastic webbing material or a scrim material.

Absorbent medium 8 is preferably made of a thermoplastic material treated with a surfactant so as to be hydrophilic. Preferably, absorbent medium 8 comprises meltblown polypropylene. Other materials of which absorbent medium 8 can be made include coform materials, which are a blend of wood pulp fluff and thermoplastic fibers with, if desired, a superabsorbent material. The preferred meltblown polypropylene can also include a superabsorbent material in order to increase its absorbency. Absorbent medium 8 can have a basis weight from about 25 to about 250 grams per square meter, and more preferably from about 50 to about 150 grams per square meter. The surfactant for treating the thermoplastic fibers can be any suitable surfactant, such as Aerosol OT manufactured by American Cyanimid, or Triton X-102 manufactured by Rohm and Haas, or the like. The amount of surfactant is generally from about 0.1 to about 1.0 percent by weight of the total weight of absorbent medium 8.

If desired, the concentration or layering of absorbent medium 8 can be selectively varied, such as by increasing the concentration or amount of absorbent in the central portion of shield 2.

Absorbent medium 8 can also comprise other agents, such as fragrance, antimicrobial materials, odor-neutralizing materials, and anti-perspirant agents. One method of including these would be by microencapsulating in water-soluble capsules and which are released on contact with moisture. Examples of these types of agents include bacteriocides, fungicides, for example, metal compounds of zinc, copper, aluminum, or cobalt. Other agents include quaternary ammonium compounds, sorbic acid, citrates, pH altering agents, and activated carbon.

The present invention also contemplates absorbent medium 8 being made of other suitable absorbent materials, for example, a cellulosic material such as an air-formed batt of wood pulp fibers, a nonwoven web of synthetic or natural fibers, a composite of meltblown fibers mixed with a cellulosic material, or a blend of cellulosic material with staple textile fibers such as Rayon. As earlier mentioned, absorbent medium 8 may also include superabsorbent materials, which include grafted starch, starch polyacrylic acid, grafted methyl cellulose, modified polyvinyl alcohols, polyacrylic acid salts that are cross-linked to form absorbent polymers, and the like. Absorbent medium 8 may also be made of a foam-type material, such as polyester, polyurethane, and ethylene vinyl acetate with polyester or polyurethane.

Figure 3:
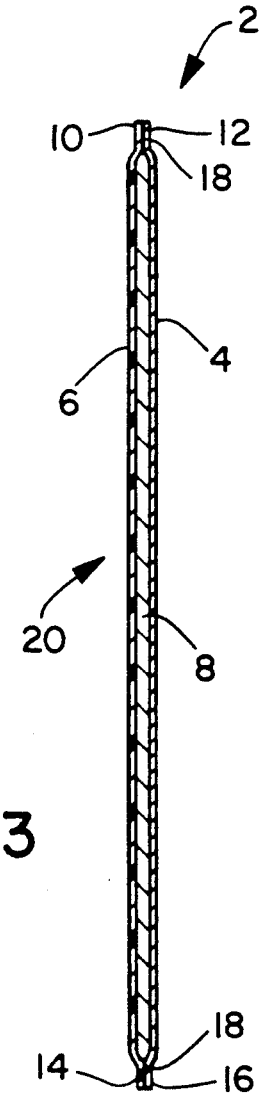
FIG. 3 is a cross-sectional view of FIG. 2 taken along line 3-3 and viewed in the direction of the arrows.

Outer cover 6 preferably comprises a film of thermoplastic material having a thickness from about 0.3 to about 1.3 mils. One side of outer cover 6 can be provided with an adhesive for bonding absorbent medium 8 thereto. Preferably, the adhesive is a soft-type adhesive that does not diminish the softness or flexibility of clothing shield 2. An example of this type adhesive is Dispo-Melt 34-5517 manufactured by National Starch Company of Bridgewater, N.J., or Findley Adhesive 952-383 manufactured by Findley Adhesives of Brookfield, Wis. This adhesive is applied in any suitable manner to one side of outer cover 6 and then absorbent medium 8 is registered thereon so as to provide a peripheral portion 10 of outer cover 6 about absorbent medium 8. Thereafter, bodyside liner 4 is placed over absorbent medium 8 and extends outwardly over absorbent medium 8 to provide a peripheral portion 12 that is generally contiguous with peripheral portion 10. Both peripheral portions 10, 12 have respective peripheral edges 14, 16, as illustrated in FIG. 3. Alternatively, in the above manufacturing steps, outer cover 6 and liner 4 may be interchanged. Thus, the adhesive could be applied in any suitable manner to one side of liner 4, and then absorbent medium 8 would be registered thereon to provide a peripheral portion. Thereafter, outer cover 6 is placed over absorbent medium 8 and extends outwardly thereover to provide another peripheral portion.

The peripheral portions 10, 12 are then joined together with a suitably soft adhesive, such as that earlier mentioned above, along a bondline 18 (FIG. 3) that is inwardly spaced from peripheral edges 14, 16. The inward placement of bondline 18 permits peripheral edges 14, 16 to be free and loose, thereby providing a soft, comfortable edge about clothing shield 2. Bondline 18 also serves as a liquid-impervious border about clothing shield 2. Preferably, bondline 18 is spaced inwardly from peripheral edges 14, 16, a distance from about 0.5 to about 5.0 millimeters. However, the peripheral portions 10, 12 can also be adhered or bonded along their total surface areas between the edge of absorbent medium 8 and peripheral edges 14, 16. Although bondline 18 was described as a line of adhesive applied between peripheral portion 10 and peripheral portion 12, the bond could also be provided by thermal bonding along bondline 18.

As mentioned above, outer cover 6 can comprise a film of thermoplastic material such as polyethylene, polypropylene, or polyolefin copolymers such as ethylene vinyl acetate, ethylene methyl acrylate, ethylene ethyl acrylate, polyvinyl chloride, Nylon, and the like.

One of the unique features of the present invention is the provision of a masking surface on the exposed side of outer cover 6, which would be adjacent the clothing. With some current clothing shields, their relative bulkiness, or the color or the particular shape or pattern on their exposed surface, is visibly discernible through the clothing adjacent thereto. Naturally, if the visibility of the clothing shield is due solely to its bulkiness, decreasing the thickness of the shield will tend to reduce its visibility through clothing. However, despite the reduction in thickness, and also possibly due to the geometric design or the pattern on the exposed external surface, the outline or pattern of the clothing shield is visually discernible through the clothing.

This visibility through the clothing is due, either in part or totally, to light reflecting the outline or pattern of clothing shield 2 through the clothing. In order to defeat the geometric or orderly reflection of light from the clothing shield, and without being bound to any specific theory, it has been discovered that the present invention provides a masking surface 20 on the external side of outer cover 6 that absorbs some of the incident light on outer cover 6 and/or randomly scatters light reflected from outer cover 6. Because the reflected light is randomly scattered, there is no clear or delineated geometric pattern or shape visually perceivable through the clothing.

Masking surface 20 is provided by a spunbonded thermoplastic layer joined to the exposed side of outer cover 6, the exposed side being that side opposite absorbent medium 8. The spunbond process provides a random distribution of thermoplastic microfibers as a coherent web. Spunbonded thermoplastic microfibers refer to small diameter fibers having a diameter not greater than about 100 microns, preferably a diameter from about 10 to about 50 microns, and more preferably a diameter from about 12 to about 30 microns. The spunbond microfibers are made by extruding a molten thermoplastic material as filaments through a plurality of fine capillaries of a spinnerette with the diameter of the extruded filaments then being rapidly reduced as by, for example, eductive drawing or other well known spunbonding mechanisms. A description of a spunbond process is disclosed in U.S. Pat. No. 4,340,563, which patent is incorporated by reference herein.

Preferably, outer cover 6 is a two-layer composite comprising an ethylene methyl acrylate extruded onto a spunbonded polypropylene layer. The ethylene methyl acrylate layer can be any suitable color, and preferably is beige-colored, and the spunbonded polypropylene is perferably white in color. The spunbonded polypropylene can have a basis weight from about 0.4 to about 0.8 ounces per square yard. FIG. 1 is a photographic view of masking surface 20 of outer cover 6. As can be clearly seen, and to a somewhat lesser degree in FIG. 4, the white-colored spunbonded polypropylene is randomly dispersed on the darker, or beige-colored, surface of the thermoplastic film layer. It has been found that when this surface is placed under clothing, it is visually masked from view. This is due to the random pattern of the spunbonded polypropylene randomly scattering the light reflected from outer cover 6. Because the reflected light is randomly scattered, there is no geometric or orderly outline, pattern, or shape reflected or viewable through the clothing. Thus, the wearer has confidence that the clothing shield is not visible to others.

Masking surface 20 may be provided by other processes other than a spunbond process, such as an intermittent meltblown process, or hydrojet-entanglement process.

Figure 6:
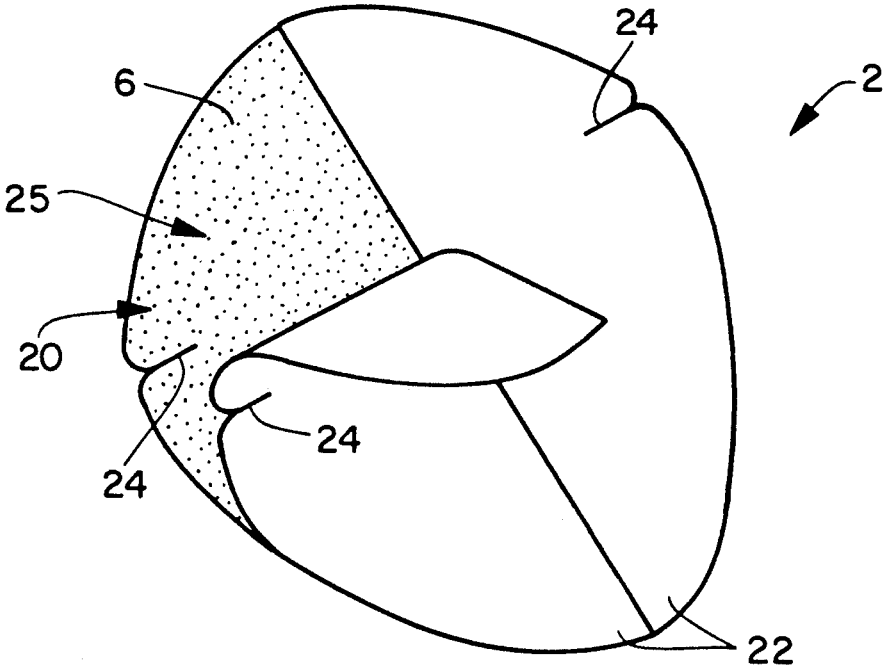
FIG. 6 is a perspective view of the preferred embodiment with a portion of the release paper being removed.

In order to apply or attach clothing shield 2, the masking surface 20 is provided with a transparent adhesive 25 indicated as dots (FIG. 6) and a peel strip 22. FIG. 6 illustrates peel strip 22 in two sections, with one of the sections being partially removed to expose the transparent adhesive 25. The transparent adhesive 25 is preferably a soft hot-melt adhesive, such as HM1972 manufactured by The H. B. Fuller Company of St. Paul, Minn., or National Starch Dispo-Melt 34-2841 manufactured by National Starch Company of Bridgewater, N.J. The adhesive may be applied on the total surface area, or in elongate strip areas or other segmented or selected sections. Peel strip 22 is preferably a silicone-coated cellulosic release paper that will adhere to transparent adhesive 25 and, upon removal, not degrade or diminish the adhesive characteristic.

Figure 2:
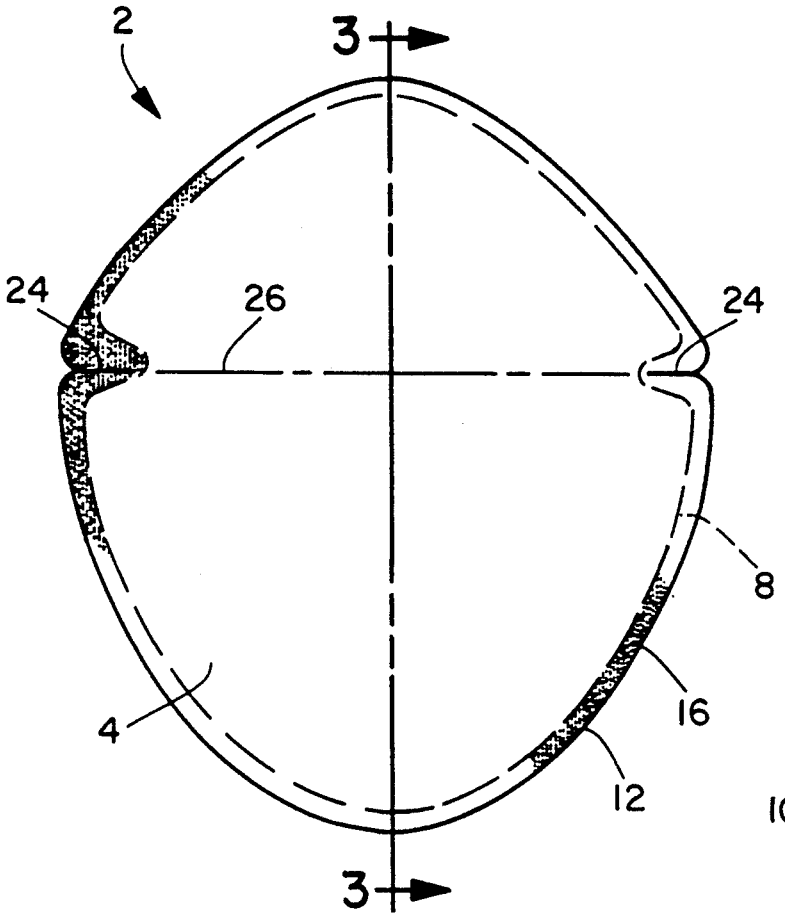
FIG. 2 is a plan view of the bodyside liner side of the preferred embodiment of the present invention.
Figure 4:
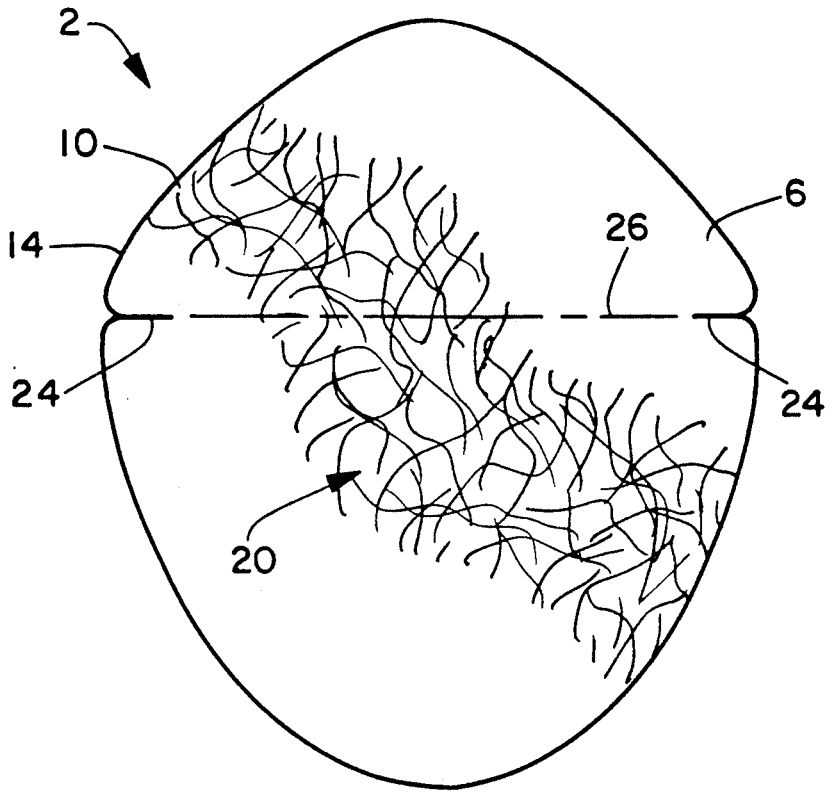
FIG. 4 is a plan view of the masking surface of the preferred embodiment of the present invention.
Figure 5:
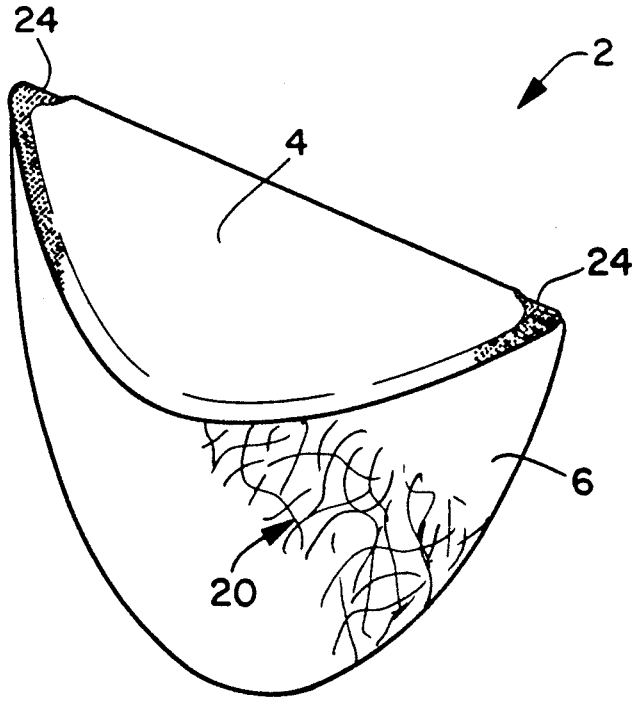
FIG. 5 is a perspective view of the preferred embodiment as it would appear during the folding or creasing step in preparation of fitting to an underarm seam of a shirt or blouse.
Figure 7:
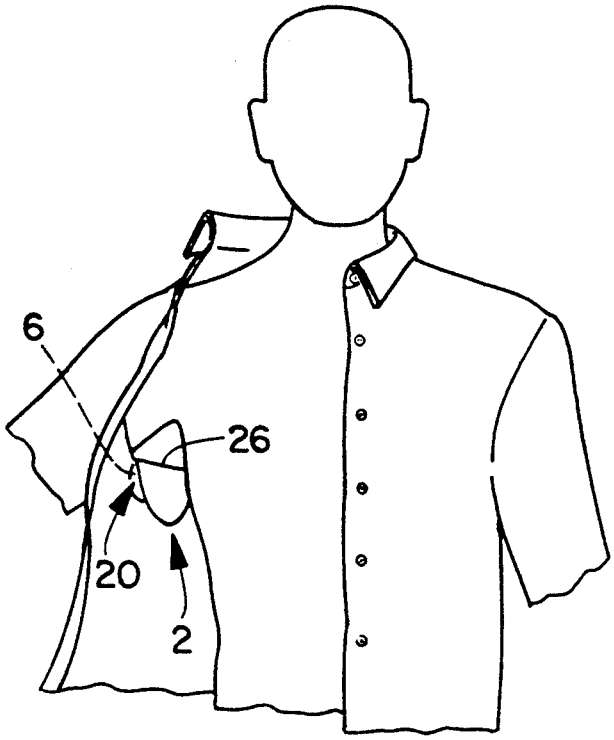
FIG. 7 is a front elevational view of a shirt or blouse illustrating the preferred embodiment fitted with the underarm seam thereof.

Referring primarily to FIGS. 2 and 4, clothing shield 2 has a pair of slits 24 disposed on generally opposite sides thereof. Each slit 24 has a length from about ¼ inch to about 1 inch, and as illustrated in FIG. 2, a dashed creaseline 26 indicates where clothing shield 2 would be folded in order to fit inside the underarm seam area of a garment or piece of clothing, as illustrated in FIG. 7. In addition to folding, it could be pinched, embossed, heat-sealed, or the like. Slits 24 aid in placement of clothing shield 2 within the garment by allowing the shield to be easily folded therealong and to aid in staying in place in the garment. As can be seen in FIG. 2, the top approximate one-third of clothing shield 2 is of a different type oval shape from the bottom approximate two-thirds of shield 2. This design results in an anatomically configured shield that conformably fits to the underarm seam area of a garment, as illustrated in FIG. 7. Generally the uppermost oval-shape portion, as viewed in FIG. 2, of shield 2 is from an oval having a more rounded or fatter shape than the oval-shape of the lowermost portion of shield 2. The joinder of these two oval-shapes is along creaseline 26, which is measured from the topmost edge of shield 2, as viewed in FIG. 2, downwardly a distance along the longitudinal centerline. This distance is from about 25% to about 45% of the total length, as measured along the longitudinal centerline, of shield 2.

Thus, shield 2 is symmetric about its vertical longitudinal axis and asymmetric about its transverse horizontal axis, as illustrated in FIG. 2. It is the asymmetric shape that results in the anatomically configured embodiment of the present invention. The anatomical shape or configuration serves not only to provide a conformable fit to the underarm seam area, but also to maximize protection between the clothes and body. Preferably, the overall weight of clothing shield 2 is from about 1.5 grams to about 5 grams, and has an overall thickness from about 0.75 millimeters to about 3.0 millimeters. Clothing shield 2 is also intended to be disposable after use. Among the types of stains prevented by use of shield 2 are body perspirant stains, and residue stains from deodorants and anti-perspirants.

Although clothing shield 2 has been described primarily for use as an underarm shield, it can have use in other areas, such as wound dressings, incontinence products and the like. The masking effect provided by the present invention can also be used on other articles or products that would preferably be masked from view.

While this invention has been described as having a preferred embodiment, it will be understood that it is capable of further modifications. This application is therefore intended to cover any variations, uses, or adaptations of the invention following the general principles thereof, and including such departures from the present disclosure as come within known or customary practice in the art to which this invention pertains and falls within the limits of the appended claims.

What is claimed is:

1. An underarm clothing shield adapted to protect the clothing of a wearer from stains, said shield comprising:
   a) an absorbent medium;
   b) a liquid-impervious cover attached to said absorbent medium, said cover having an exposed side adjacent the clothing of a wearer during use; and
   c) a masking surface joined to said cover said masking surface comprising a random distribution of thermoplastic microfibers wherein said masking surface renders said shield visually non-discernible through the clothing of a wearer while in use.

2. The shield according to claim 1 wherein said absorbent medium includes a surfactant treated thermoplastic material.

3. The shield according to claim 2 wherein the thermoplastic material is meltblown polypropylene.

4. The shield according to claim 1 wherein said absorbent medium includes coform materials.

5. The shield according to claim 1 wherein said water-impervious cover comprises a film of thermoplastic material.

6. The shield according to claim 5 wherein said thermoplastic material is selected from the group consisting of (poly)ethylene, (poly)propylene, (poly)ethylene vinyl acetate, (poly)ethylene methyl acrylate, (poly-)ethylene ethyl acrylate, (poly)vinyl chloride, and Nylon.

7. The shield according to claim 1 wherein said water-impervious cover further comprises a beige colored surface.

8. The shield according to claim 1 wherein the masking surface randomly scatters light reflected from said water-impervious cover.

9. The shield according to claim 1 wherein the masking surface comprises a spunbonded thermoplastic layer joined to the exposed side of said water-impervious cover.

10. The shield according to claim 9 wherein said spunbonded thermoplastic layer is a coherent wed of randomly distributed thermoplastic microfibers having a diameter not greater than about 100 microns.

11. The shield according to claim 10 wherein said thermoplastic microfibers are white.

12. The shield according to claim 10 wherein said thermoplastic microfibers are formed from polypropylene.

13. The shield according to claim 12 wherein said coherent web has a basis weight from about 0.4 to about 0.8 ounces per square yard.

14. The shield according to claim 1 wherein said thermoplastic microfibers are formed by an intermittent meltblown process.

15. The shield according to claim 1 wherein said thermoplastic microfibers are formed by a hydrojet entanglement process.

16. The shield according to claim 1 further comprising a liquid-pervious bodyside liner.

17. The shield according to claim 16 wherein the bodyside liner and cover are joined together along a bondline that is spaced inwardly from peripheral edges of said bodyside liner and cover.

18. The shield according to claim 1 further comprising transparent adhesive applied to said masking surface.

19. The shield according to claim 1 wherein said shield defines a pair of slits disposed on generally opposite sides thereof, whereby said shield is creased or folded at said slits to allow proper placement of said shield.

20. The shield according to claim 1 wherein said thermoplastic microfibers are formed by a spunbond process.

21. An underarm clothing shield adapted to protect the clothing of a wearer from stains, said shield comprising:

a) an absorbent medium having first and second opposed planar surfaces;

b) a bodyside liner attached to said first opposed planar surface of said absorbent medium;

c) a liquid-impervious cover attached to said second opposed planar surface of said absorbent medium, said cover comprising a masking surface comprising a random distribution of thermoplastic microfibers, said masking surface being adjacent the clothing of a wearer during use; and d) an adhesive applied to the masking surface.

22. The shield according to claim 21 wherein said cover comprises an ethylene-methyl acrylate copolymer extruded onto a spunbonded polypropylene layer.

23. An underarm clothing shield adapted to protect the clothing of a wearer from stains, said shield comprising:

a) an absorbent medium having first and second opposed planar surfaces;

b) a bodyside liner attached to said first opposed planar surface of said absorbent medium;

c) a liquid-impervious cover attached to said second opposed planar surface of said absorbent medium, said cover having an exposed side adjacent the clothing of a wearer during use;

(d) a masking surface joined to said cover, said masking surface comprising a random distribution of thermoplastic microfibers; and e) a transparent adhesive applied to the masking surface.

24. A method of making an underarm clothing shield adapted to protect the clothing of a wearer from stains, said method comprising the steps of:

a) joining an absorbent medium to a liquid-impervious cover, said cover having an exposed side adjacent the clothing of a wearer during use; and b) forming a masking surface on said exposed side of said cover, wherein said masking surface comprises a random distribution of thermoplastic microfibers and renders said shield visually non-discernible through the clothing while in use.

25. The method according to claim 24 wherein said forming step includes attaching a web of said thermoplastic microfibers to said exposed side of said cover.

26. The method according to claim 24 wherein said forming step includes attaching a web of said thermoplastic microfibers to said cover which thermoplastic microfibers are spunbonded.

27. The method according to claim 24 further comprising the step of attaching a bodyside liner to said cover such that the absorbent medium is located between said bodyside liner and said cover.

28. The method according to claim 27 further comprising the step of applying a transparent adhesive to said masking surface.

* * * * *